US010600276B2

(12) United States Patent
Osmond et al.

(10) Patent No.: US 10,600,276 B2
(45) Date of Patent: Mar. 24, 2020

(54) MULTI-GAME GAMING MACHINE

(71) Applicant: Aristocrat Technologies Australia Pty Limited, North Ryde, NSW (AU)

(72) Inventors: Joel Osmond, Quakers Hill (AU); Renish Gami, Pendle Hill (AU); Claire Mileto, Ropes Crossing (AU); Marc Mayo, Bass Hill (AU); Julie Howells, Kings Langley (AU); Shaun Ruhle, Whiteside (AU); Natalie Bryant, Cherrybrook (AU)

(73) Assignee: ARISTOCRAT TECHNOLOGIES AUSTRALIA PTY LIMITED, North Ryde, NSW (AU)

( * ) Notice: Subject to any disclaimer, the term of this patent is extended or adjusted under 35 U.S.C. 154(b) by 0 days.

(21) Appl. No.: 15/663,656

(22) Filed: Jul. 28, 2017

(65) Prior Publication Data

US 2018/0033237 A1 Feb. 1, 2018

(30) Foreign Application Priority Data

Jul. 28, 2016 (AU) ..... 2016208393

(51) Int. Cl.
*G07F 17/32* (2006.01)

(52) U.S. Cl.
CPC ..... *G07F 17/3211* (2013.01); *G07F 17/3209* (2013.01); *G07F 17/3225* (2013.01); *G07F 17/3246* (2013.01); *G07F 17/3251* (2013.01); *G07F 17/3258* (2013.01)

(58) Field of Classification Search
CPC ..... G07F 17/32; G07F 17/323
See application file for complete search history.

(56) References Cited

U.S. PATENT DOCUMENTS

| | | | | |
|---|---|---|---|---|
| 9,355,522 | B2 * | 5/2016 | Wood | G07F 17/326 |
| 9,552,689 | B2 * | 1/2017 | Walther | G07F 17/32 |
| 9,824,523 | B2 * | 11/2017 | Cannon | G07F 17/32 |
| 2005/0282637 | A1 * | 12/2005 | Gatto | A63F 13/12 463/42 |
| 2008/0167119 | A1 * | 7/2008 | Willis | G07F 17/32 463/25 |

(Continued)

*Primary Examiner* — James S. McClellan
*Assistant Examiner* — Kevin M Carter
(74) *Attorney, Agent, or Firm* — McAndrews, Held & Malloy, Ltd.

(57) ABSTRACT

A multi-game gaming machine comprises a touch screen display, and a controller responsive to a configuration command to enter a configuration mode in which the controller controls the touch screen display to display a configuration menu including a game package selection sub-menu. The gaming machine is operable in the configuration mode to select between a plurality of game packages that are different from one another, each game package comprising a plurality of games playable on the gaming machine when the respective game package is selected. The controller controls the touch screen display to display a game selection interface when the gaming machine is in a game selection mode, the game selection interface including game images corresponding to each game of the selected game package. The controller is responsive to a touch input in respect of a respective game image to change the touch screen display to reflect selection of the game associated with the respective game image.

16 Claims, 14 Drawing Sheets

(56) References Cited

U.S. PATENT DOCUMENTS

| | | | | |
|---|---|---|---|---|
| 2011/0014971 | A1* | 1/2011 | Ward | G07F 17/32 463/25 |
| 2011/0119754 | A1* | 5/2011 | Larsen | G07F 17/32 726/16 |
| 2011/0250953 | A1* | 10/2011 | Iyer | G07F 17/32 463/29 |
| 2013/0337900 | A1* | 12/2013 | Cannon | G07F 17/32 463/25 |

* cited by examiner

MULTI-GAME GAMING MACHINE

RELATED APPLICATIONS

This application claims priority to Australia Provisional Patent Application No. 2016208393 having an International filing date of Jul. 28, 2016, which is incorporated herein by reference in its entirety.

FEDERALLY SPONSORED RESEARCH OR DEVELOPMENT

[Not Applicable]

MICROFICHE/COPYRIGHT REFERENCE

[Not Applicable]

BACKGROUND OF THE INVENTION

While there are existing multi-game gaming machines, a need exists for alternative multi-game gaming machines.

BRIEF SUMMARY OF THE INVENTION

In a first aspect, there is provided a multi-game gaming machine comprising:

a touch screen display; and a controller responsive to a configuration command to enter a configuration mode in which the controller controls the touch screen display to display a configuration menu including a game package selection sub-menu, the gaming machine operable in the configuration mode to select between a plurality of game packages that are different from one another, each game package comprising a plurality of games playable on the gaming machine when the respective game package is selected, the controller controlling the touch screen display to display a game selection interface when the gaming machine is in a game selection mode, the game selection interface including game images corresponding to each game of the selected game package, the controller responsive to a touch input in respect of a respective game image to change the touch screen display to reflect selection of the game associated with the respective game image.

In an embodiment, the plurality of predefined game packages comprises at least one game package that has a different number of games to at least one other game package.

In an embodiment, the plurality of predefined game packages comprises at least one game package that has a game playable in a different denomination to a game of at least one other game package.

In an embodiment, the controller is configured to control a layout of the game images based on the number of games.

In an embodiment, the controller is configured to select a layout of the game images from among a plurality of different layouts based on the number of games.

In a second aspect, there is provided a method of operating a multi-game gaming machine comprising a touch screen display and a controller, the method comprising:

entering a configuration mode of the gaming machine responsive to a configuration command, wherein when in the configuration mode, the controller controls the touch screen display to display a configuration menu including a game package selection sub-menu and the gaming machine is operable to select between a plurality of game packages that are different from one another, each game package comprising a plurality of games playable on the gaming machine when the respective game package is selected, controlling the touch screen display to display a game selection interface when the gaming machine is in a game selection mode, the game selection interface including game images corresponding to each game of the selected game package, the controller responsive to a touch input in respect of a respective game image to change the touch screen display to reflect selection of the game associated with the respective game image.

In a third aspect, there is provided a multi-game gaming machine comprising:

a memory;

a touch screen display; and a controller that controls the touch screen display to display a game selection interface which enables a player to select one of a plurality of different games playable on the gaming machine, at least one game playable in a different denomination to another game, wherein the controller is configured to maintain at least one jackpot pool in the memory corresponding to a jackpot prize winnable irrespective of which of the plurality of games is played by a player on the gaming machine, wherein the gaming machine is configured such that the chance of the jackpot being won is proportional to a total amount wagered irrespective of a denomination of the game selected for play by the player.

In an embodiment, each game has a first jackpot triggering mechanism specific to the game and a random jackpot trigger.

In an embodiment, odds of the random jackpot trigger occurring within a specific game ensure that the chance of the jackpot being won is proportional to a total amount wagered.

In an embodiment, the jackpot prize is a progressive prize, and the controller is configured to update the jackpot prize based on jackpot contributions derived from play of the plurality of different games playable on the gaming machine.

In a fourth aspect, there is provided a method of operating a multi-game gaming machine comprising a touch screen display, a memory and a controller, the method comprising:

controlling the touch screen display with the controller to display a game selection interface which enables a player to select one of a plurality of different games playable on the gaming machine, at least one game playable in a different denomination to another game;

maintaining, with the controller, at least one jackpot pool in the memory corresponding to a jackpot prize winnable irrespective of which of the plurality of games is played by a player on the gaming machine;

controlling the gaming machine such that the chance of the jackpot prize being won is proportional to a total amount wagered irrespective of a denomination of the game selected for play by the player.

BRIEF DESCRIPTION OF SEVERAL VIEWS OF THE DRAWINGS

An exemplary embodiment of the invention will now be described with reference to the accompanying drawings in which.

DETAILED DESCRIPTION OF THE INVENTION

Figure 1:
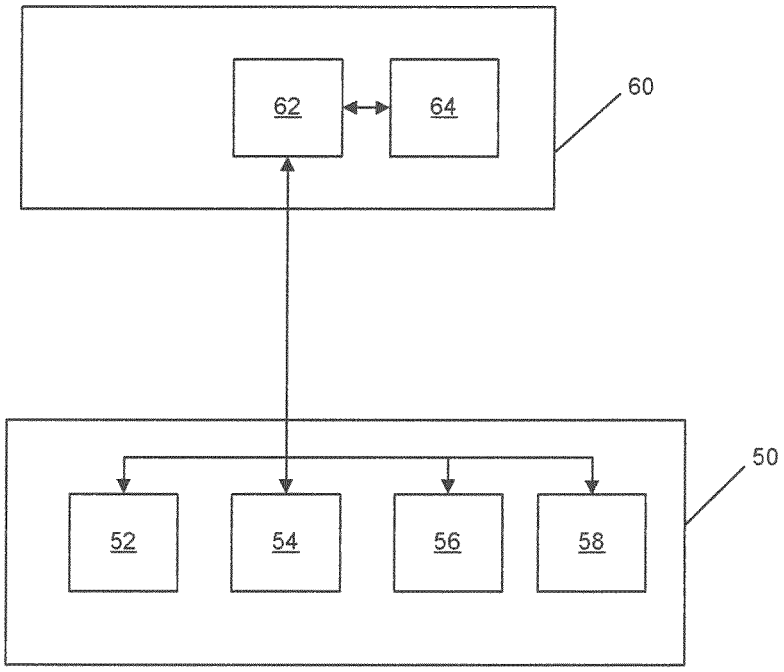
FIG. 1 is a block diagram of the core components of a gaming machine.

Referring to the drawings, there are shown multi-game gaming machines and methods of operating a multi-game gaming machine of embodiments of the invention. In an embodiment, the multi-game gaming machine is operable to select between different game packages, thus providing operator flexibility.

In an embodiment, a multi gaming machine has several core components. At the broadest level, the core components are a player interface 50 and a game controller 60 as illustrated in FIG. 1. The player interface is arranged to enable manual interaction between a player and the gaming machine and for this purpose includes the input/output components required for the player to enter instructions to play the game and observe the game outcomes.

Components of the player interface may vary from embodiment to embodiment but will typically include a credit mechanism 52 to enable a player to input credits and receive payouts, one or more displays 54, a game play mechanism 56 including one or more input devices that enable a player to input game play instructions (e.g. to place a wager), and one or more speakers 58.

The game controller 60 is in data communication with the player interface and typically includes a processor 62 that processes game play instructions and outputs game play outcomes to the display. Typically, the game play instructions are stored as program code in a memory 64. Herein the term "processor" is used to refer generically to any device that can process game play instructions and may include: a microprocessor, microcontroller, programmable logic device or other computational device. That is a processor may be provided by any suitable logic circuitry for receiving inputs, processing them in accordance with instructions stored in memory and generating outputs (for example on the display). Such processors are sometimes also referred to as central processing units (CPUs). Most processors are general purpose units, however, it is also know to provide a specific purpose processor using an application specific integrated circuit (ASIC) or a field programmable gate array (FPGA).

Figure 2:
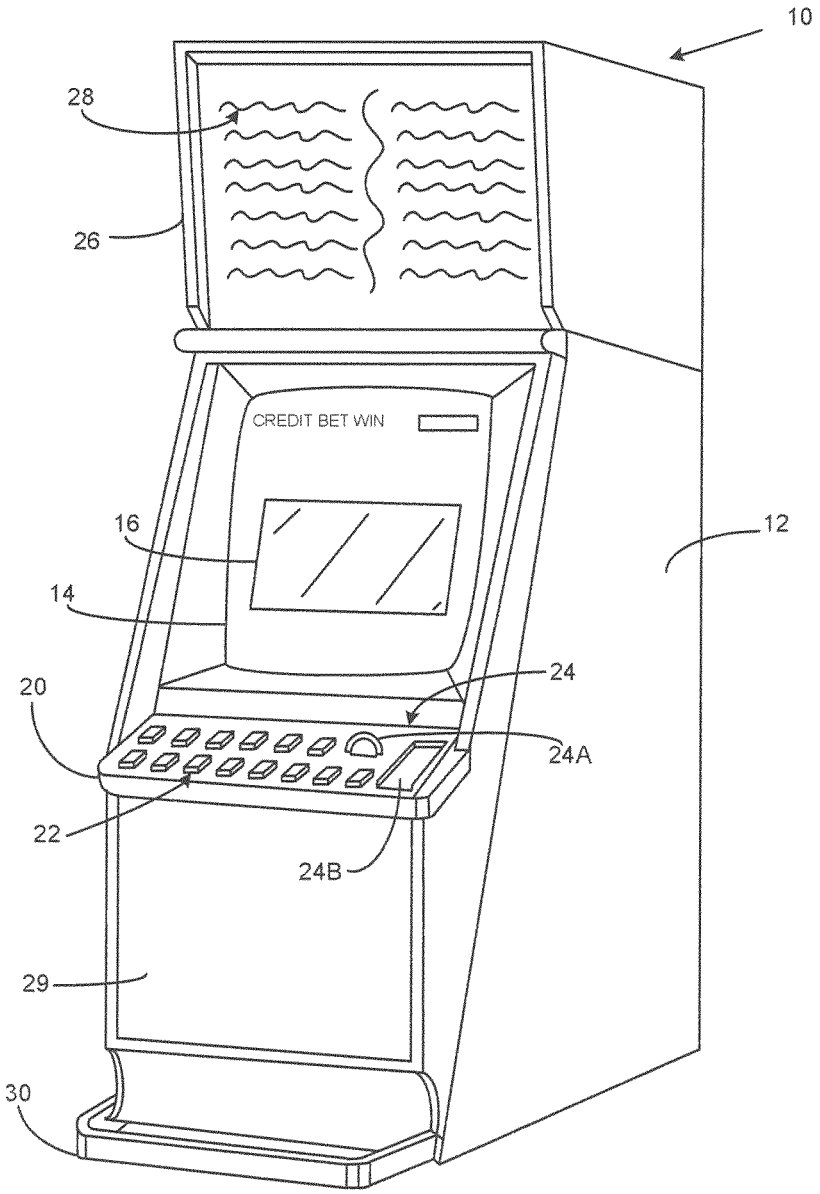
FIG. 2 is a perspective view of a gaming machine.

A gaming machine 10 is illustrated in FIG. 2. The gaming machine 10 includes a console 12 having a display 14 on which are displayed representations of a game 16 that can be played by a player. A mid-trim 20 of the gaming machine 10 houses a bank of buttons 22 for enabling a player to interact with the gaming machine, in particular during game play. The mid-trim 20 also houses a credit input mechanism 24 which in this example includes a coin input chute 24A and a bill collector 24B. Other credit input mechanisms may also be employed, for example, a card reader for reading a smart card, debit card or credit card. Other gaming machines may be configured for "ticket in" such that they have a ticket reader for reading tickets having a value and crediting the player based on the face value of the ticker. A player marketing module (not shown) having a reading device may also be provided for the purpose of reading a player tracking device, for example as part of a loyalty program. The player tracking device may be in the form of a card, flash drive or any other portable storage medium capable of being read by the reading device. In some embodiments, the player marketing module may provide an additional credit mechanism, either by transferring credits to the gaming machine from credits stored on the player tracking device or by transferring credits from a player account in data communication with the player marketing module that is accessed in response to insertion of the player tracking device.

A top box 26 may carry artwork 28, including for example pay tables and details of bonus awards and other information or images relating to the game. Further artwork and/or information may be provided on a front panel 29 of the console 12. A coin tray 30 is mounted beneath the front panel 29 for dispensing cash payouts from the gaming machine 10.

The display 14 shown in FIG. 2 is in the form of a liquid crystal display. The display 14 may be any other suitable video display unit, such as an OLED display. The top box 26 may also include a display, which may be of the same type as the display 14, or of a different type.

Figure 3:
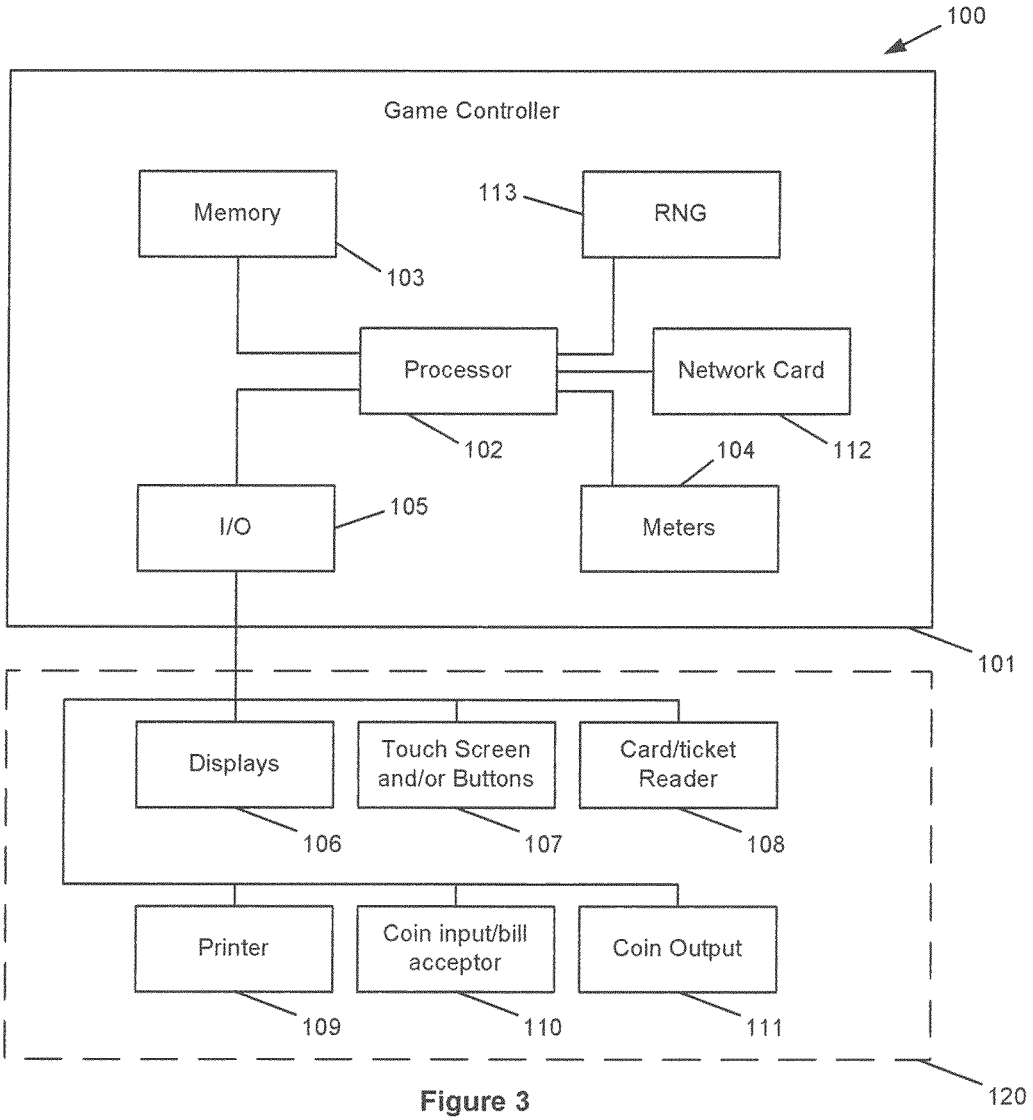
FIG. 3 is a block diagram of the functional components of a gaming machine.

FIG. 3 shows a block diagram of operative components of a typical gaming machine which may be the same as or different to the gaming machine of FIG. 2.

The gaming machine 100 includes a game controller 101 having a processor 102 mounted on a circuit board. Instructions and data to control operation of the processor 102 are stored in a memory 103, which is in data communication with the processor 102. Typically, the gaming machine 100 will include both volatile and non-volatile memory and more than one of each type of memory, with such memories being collectively represented by the memory 103.

The gaming machine has hardware meters 104 for purposes including ensuring regulatory compliance and monitoring player credit, an input/output (I/O) interface 105 for communicating with peripheral devices of the gaming machine 100. The input/output interface 105 and/or the peripheral devices may be intelligent devices with their own memory for storing associated instructions and data for use with the input/output interface or the peripheral devices. A random number generator module 113 generates random numbers for use by the processor 102. Persons skilled in the art will appreciate that the reference to random numbers includes pseudo-random numbers.

In the example shown in FIG. 3, a player interface 120 includes peripheral devices that communicate with the game controller 101 including one or more displays 106, a touch screen and/or buttons 107 (which provide a game play mechanism), a card and/or ticket reader 108, a printer 109, a bill acceptor and/or coin input mechanism 110 and a coin output mechanism 111. Additional hardware may be included as part of the gaming machine 100, or hardware may be omitted as required for the specific implementation. For example, while buttons or touch screens are typically used in gaming machines to allow a player to place a wager and initiate a play of a game any input device that enables the player to input game play instructions may be used. For example, in some gaming machines a mechanical handle is used to initiate a play of the game. Persons skilled in the art will also appreciate that a touch screen can be used to emulate other input devices, for example, a touch screen can display virtual buttons which a player can "press" by touching the screen where they are displayed.

In addition, the gaming machine 100 may include a communications interface, for example a network card 112. The network card may, for example, send status information, accounting information or other information to a bonus controller, central controller, server or database and receive data or commands from the bonus controller, central controller, server or database. In embodiments employing a player marketing module, communications over a network may be via player marketing module—i.e. the player marketing module may be in data communication with one or more of the above devices and communicate with it on behalf of the gaming machine.

Figure 4:
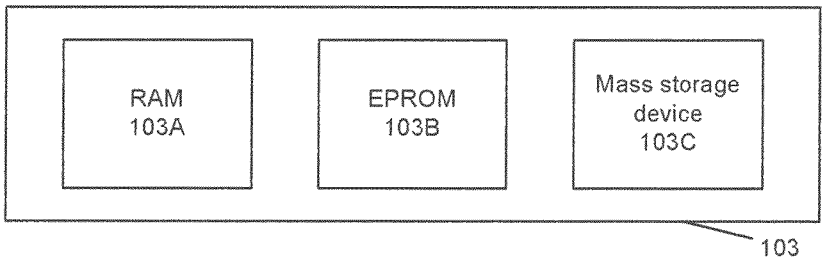
FIG. 4 is a schematic diagram of the functional components of a memory.

FIG. 4 shows a block diagram of the main components of an exemplary memory 103. The memory 103 includes RAM 103A, EPROM 103B and a mass storage device 103C. The RAM 103A typically temporarily holds program files for execution by the processor 102 and related data. The EPROM 103B may be a boot ROM device and/or may contain some system or game related code. The mass storage device 103C is typically used to store game programs, the integrity of which may be verified and/or authenticated by the processor 102 using protected code from the EPROM 103B or elsewhere.

It is also possible for the operative components of the gaming machine 100 to be distributed, for example input/output devices 106,107,108,109,110,111 to be provided remotely from the game controller 101.

Figure 5:
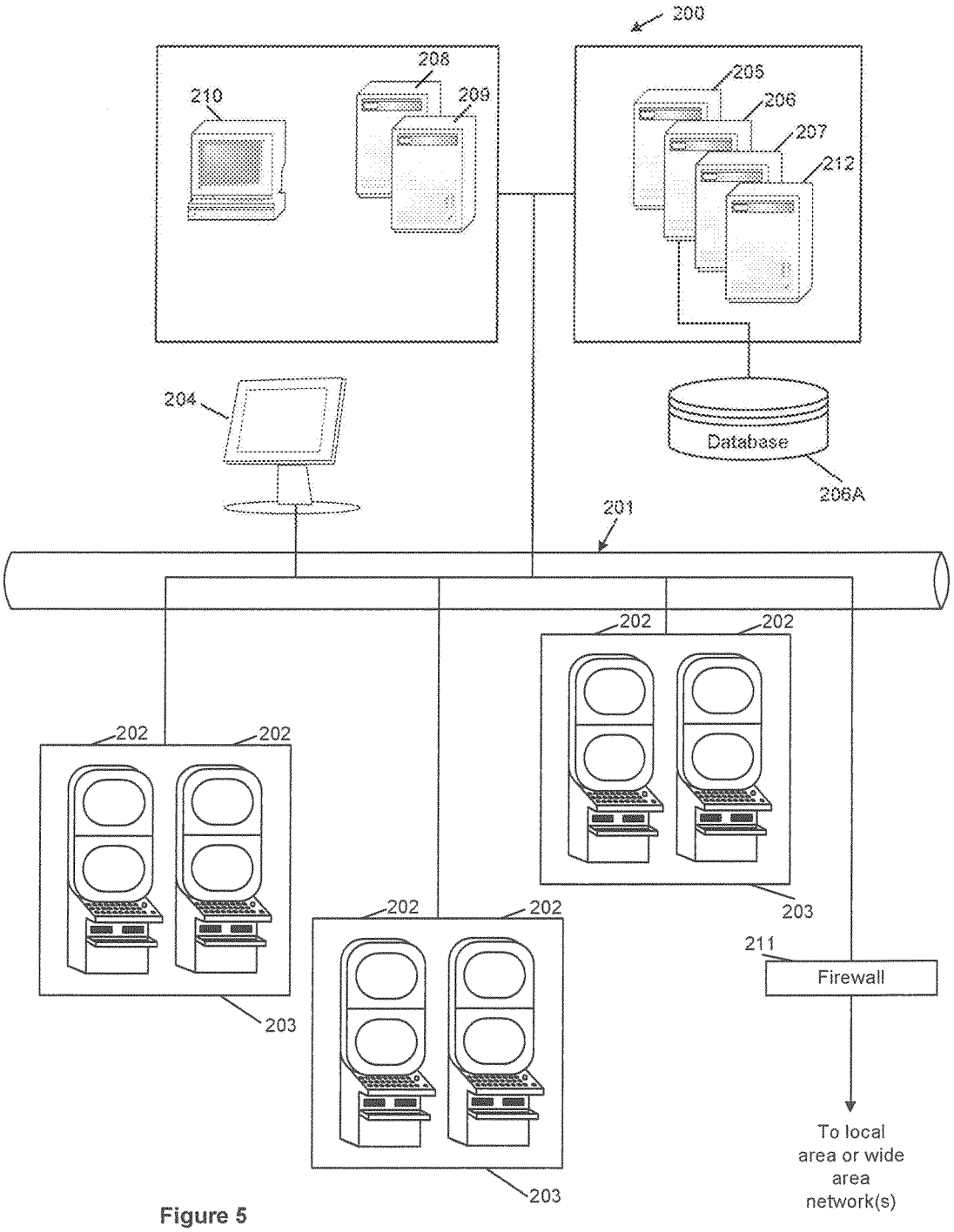
FIG. 5 is a schematic diagram of a network gaming system including a gaming machine.

FIG. 5 shows a gaming system 200 in accordance with an alternative embodiment. The gaming system 200 includes a network 201, which for example may be an Ethernet network. Gaming machines 202, shown arranged in three banks 203 of two gaming machines 202 in FIG. 5, are connected to the network 201. The gaming machines 202 may be the same as the gaming machines 10,100 shown in FIGS. 2 and 3. While banks 203 of two gaming machines are illustrated in FIG. 5, banks of one, three or more gaming machines are also envisaged.

One or more displays 204 may also be connected to the network 201. For example, the displays 204 may be associated with one or more banks 203 of gaming machines. The displays 204 may be used to display representations associated with game play on the gaming machines 202, and/or used to display other representations, for example promotional or informational material.

If the gaming system enables players to participate in a networked Jackpot game, a Jackpot server 207 will be provided to perform accounting functions for the Jackpot game. A loyalty program server 212 may also be provided.

Servers are also typically provided to assist in the administration of the gaming network 200, including for example a gaming floor management server 208, and a licensing server 209 to monitor the use of licenses relating to particular games. An administrator terminal 210 is provided to allow an administrator to run the network 201 and the devices connected to the network.

The gaming system 200 may communicate with other gaming systems, other local networks, for example a corporate network, and/or a wide area network such as the Internet, for example through a firewall 211.

Persons skilled in the art will appreciate that in accordance with known techniques, functionality at the server side of the network may be distributed over a plurality of different computers. For example, elements may be run as a single "engine" on one server or a separate server may be provided.

Further Detail of Gaming Machine

Figure 6:
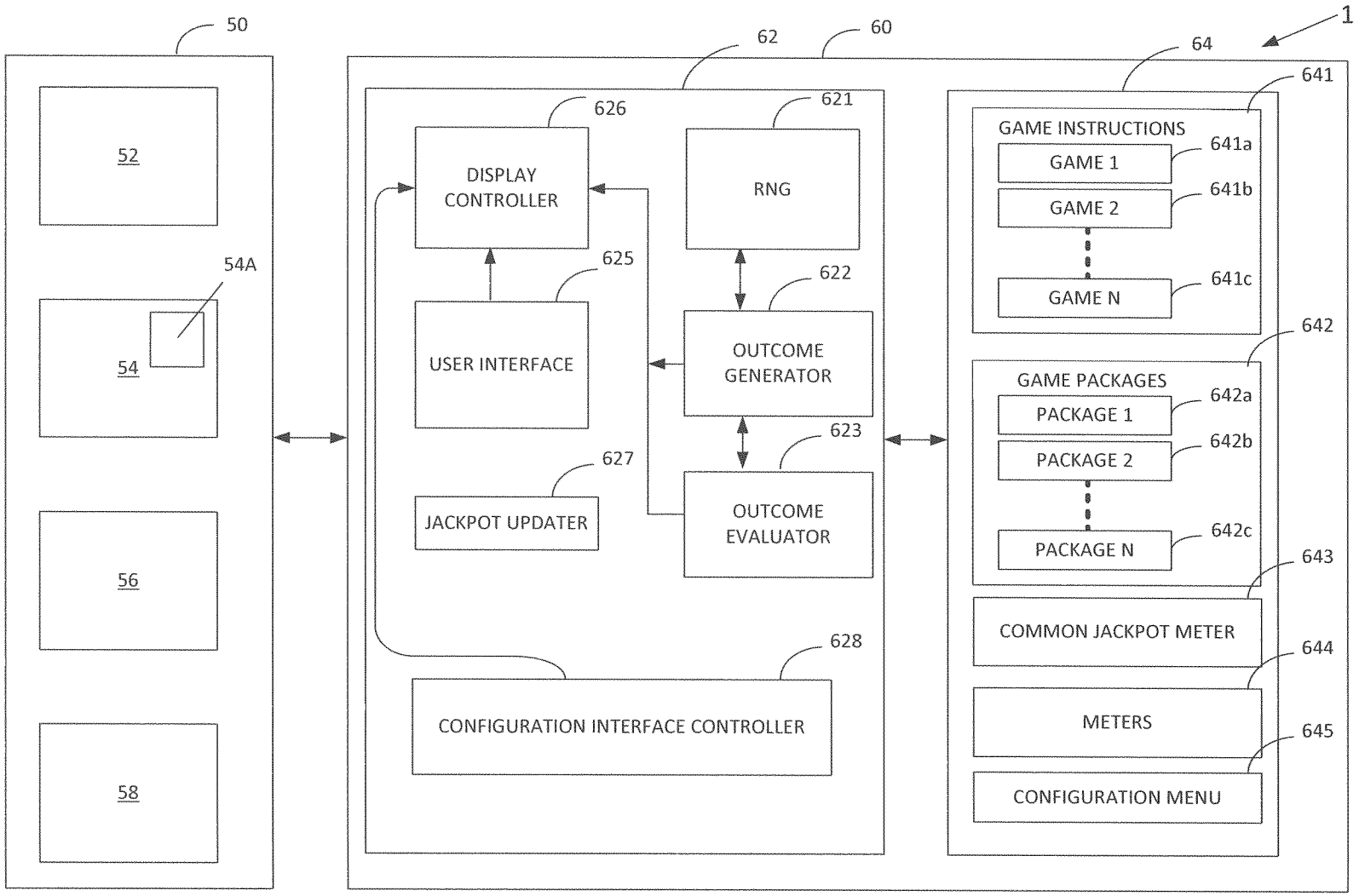
FIG. 6 is a further block diagram of a gaming machine.

In FIG. 6, the processor 62 of game controller 60 is shown implementing a number of modules based on program code and data stored in memory 64. Persons skilled in the art will appreciate that various of the modules could be implemented in some other way, for example by a dedicated circuit.

Referring to FIG. 6, there is shown a block diagram of a gaming machine 1 of an embodiment. A gaming machine comprises a controller 60 having a processor 62 and memory 64. The controller 60 is responsive to receipt of a configuration command to enter a configuration mode in which a configuration interface controller 628 of controller 60 causes the display 626 to display a configuration menu 645. The configuration menu 645 is stored in memory 64. That is, the configuration menu 54A is displayed as a configuration 54A on the display 54.

Depending on the implementation, the technician who is accessing the game machine may be required to comply with certain security requirements. For example, the configuration menu 54A may only be accessible by the touch screen display 54 when the gaming machine is opened using a special access key. In other embodiments, the technician may have to perform certain functions such as a memory clear before accessing the configuration menu. In some embodiments, the technician may be able to use the instruction input mechanism 56 to interact with the configuration menu. In other embodiments, the user may be required to connect an input device to the gaming machine in order to interact with the configuration menu.

In other embodiments, the configuration menu may be accessible via a network such as that shown in FIG. 5 in order that the user can remotely access the configuration menu 645.

Figure 8:
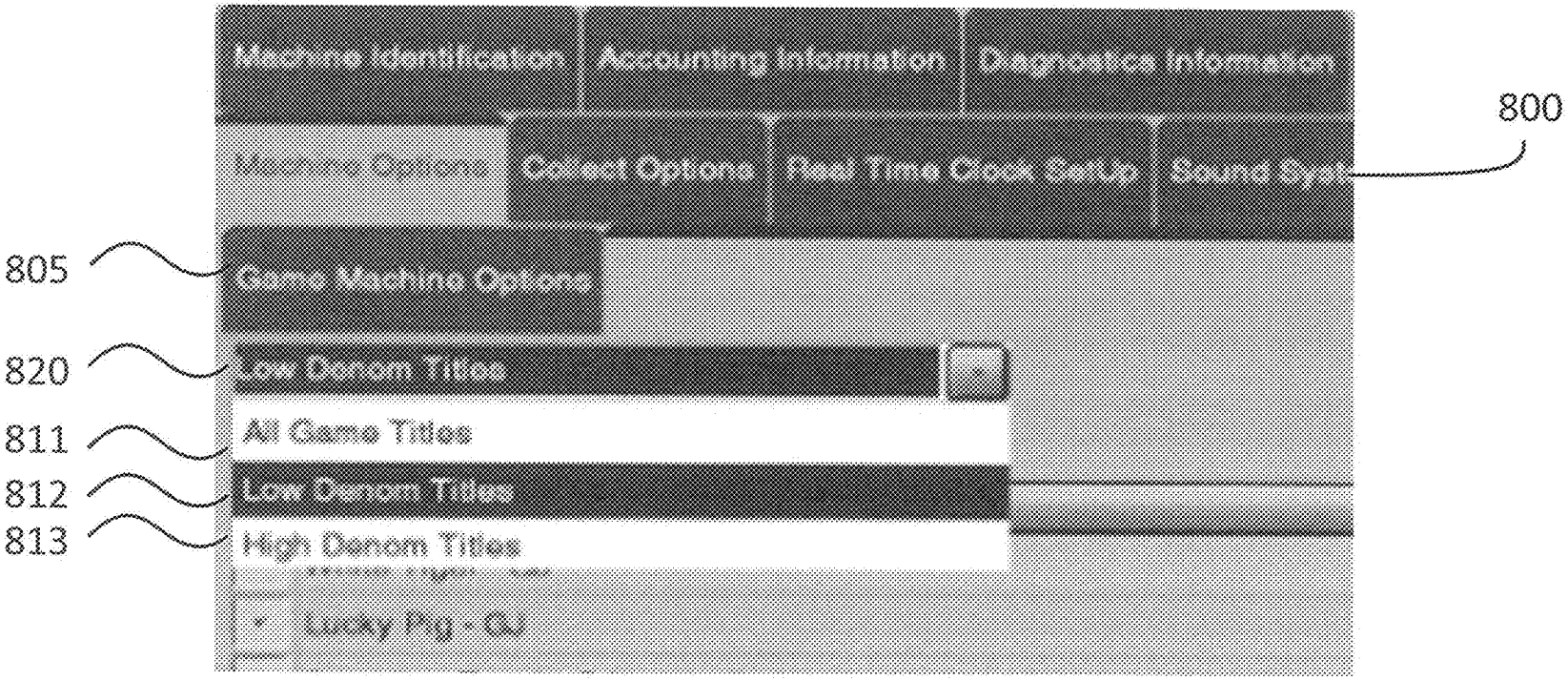
FIG. 8 shows a portion of a configuration menu of an embodiment.

Referring to FIG. 8, a portion 800 of the configuration menu is shown from which it will be apparent that there is a gaming machine option sub-menu 805 that has a drop-down menu 820 operable by the user to select from a plurality of separate game packages. The drop-down menu 820 displays the currently selected game package 'low denom titles'. The drop-down menu 820 displays the options selectable by the user including 'all game titles' 811, low denom titles 812, and 'high denom titles' 813. It will be apparent that the low denom titles 812 are highlighted in the drop-down menu to indicate that they are the currently selected game package.

The game packages 642 are stored in memory 64 which indicates that there are a plurality of different game packages 642A, 642B, and 642C. FIG. 6 illustrates that there may be any number N of different game packages whereas the example in FIG. 8 shows 3 different game packages. The number of game packages that are available will vary from embodiment to embodiment.

Each game package 642A, 642B, and 642C comprises a plurality of games playable on the gaming machine when the respective game package is selected. To this end, memory stores game instructions 641 for each of a plurality (N) of games 641A, 641B, 641C. Different games will be available for play in different game packages however there also may be some overlap between the sets of game packages. For example, in FIG. 8 the first set of game packages comprises all game packages available in the gaming machine, being all game titles, the low denom titles comprise a first subset of all game titles and the high denom titles comprise a second subset of all game titles.

Figure 9:
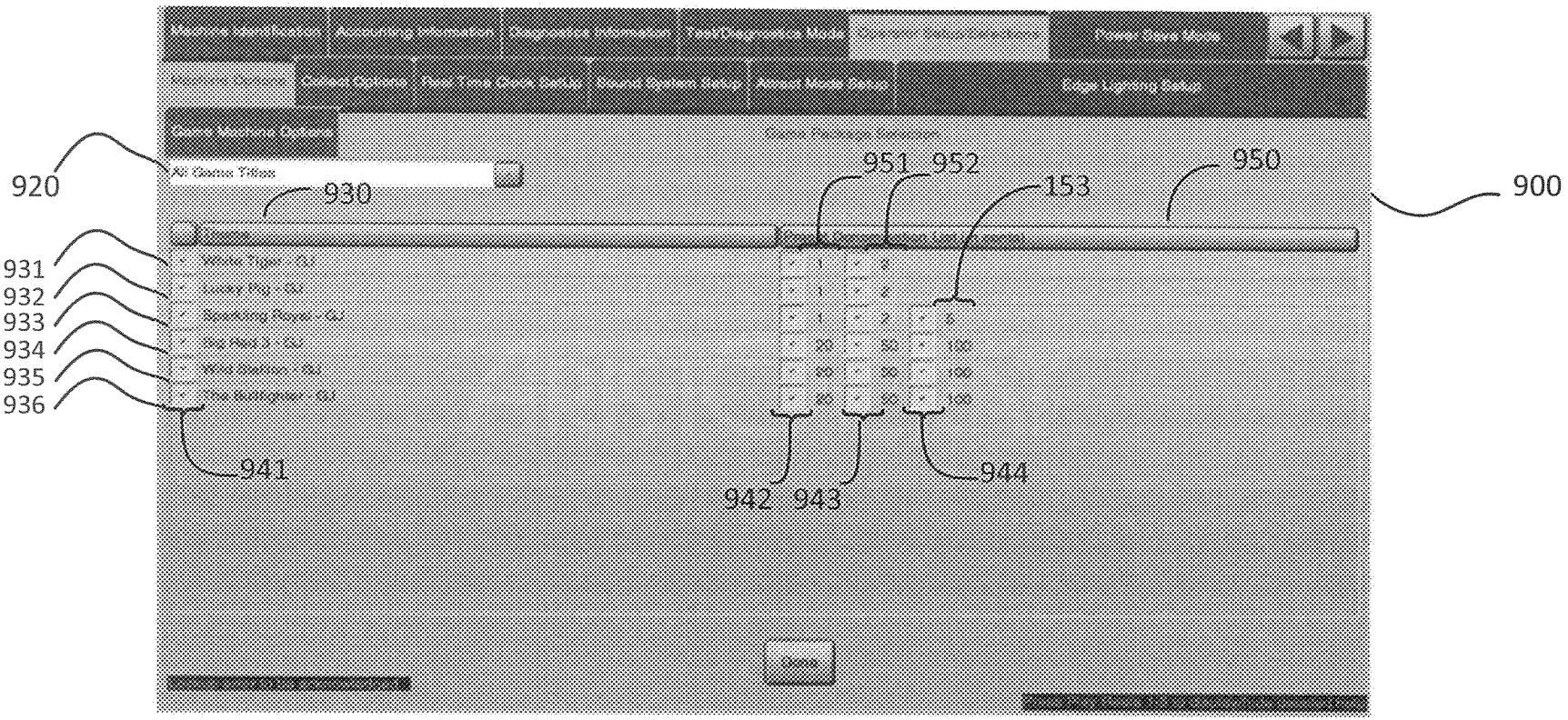
FIG. 9 shows a configuration menu of an embodiment with an example of a selection of a game package.

Referring to FIG. 9, there is shown the gaming configuration menu in which all game titles 920 have been selected. The games are listed under the heading 'theme' 930 and the available denominations (or variations of the game that are available) are listed under the heading 'preset denomination list' 950. Thus, as shown in FIG. 9, there are six games, namely White Tiger 931, Lucky Pig 932, Sparkling Royal 933, Big Red Three 934, Wild Stallion 935, and The Bull Fighter 936. Checkboxes 941 are provided to the left of each of these game titles which include a checkmark in this embodiment to indicate that the games are selected. In some embodiments, it may be possible for the user to deselect various of these games. In other embodiments, the user may not be allowed to touch the checkbox. In such embodiments, the checkboxes 941 can be greyed out to indicate that the user cannot interact with it. In further embodiments, the user may be able to deselect some but not all games. For example, some games may be regarded as optional whereas others are mandatory. In further embodiments, there may be restrictions on the number of games which can be selected or deselected. For example, there may be a minimum of three games such that if the player has already selected to remove three of the games the player cannot remove any more. Alternatively, the player having selected all game titles may be required to maintain at least one low denom title and at least one high denom title. In this example, the low denom titles are White Tiger, Lucky Pig and Sparkling Royal with the high denom titles being Big Red Three, Wild Stallion and The Bull Fighter.

Under the pre-set denomination list heading 950 there are shown three columns 951, 952, 953 of different denominations from which it will be apparent that for some games there are two different denominations available and for others there are three. The values in each of the columns 951, 952, 953 are in cents. Again, checkboxes 942, 943, 944 are provided which in some embodiments may allow selection of particular denominations. In other embodiments, selection of particular denominations may be prevented or be subject to similar requirements described above in relation to the games. For example, it may not be possible to deselect more than one denomination for each game, it may be a requirement that each of the games has a plurality of denominations, etc. In an embodiment, the selectability of check boxes can be controlled by controller 60 to ensure that the user complies with to be done within the restrictions or regulations for a market. In another embodiment, the selectability of check boxes can be controlled controller 60 to ensure that the user complies with commercial restrictions. In some embodiments the default may not be that all denominations of a game of a game package are selected. For example, the default could be that a subset of games or denominations of a game package are selected and the user may be able to add an additional game(s) or denomination (s).

It will be apparent from FIG. 9 that all six games in all sixteen different denominations have been selected so that effectively sixteen different game variants are playable on the multi-game gaming machine 1 of FIG. 6.

Figure 10:
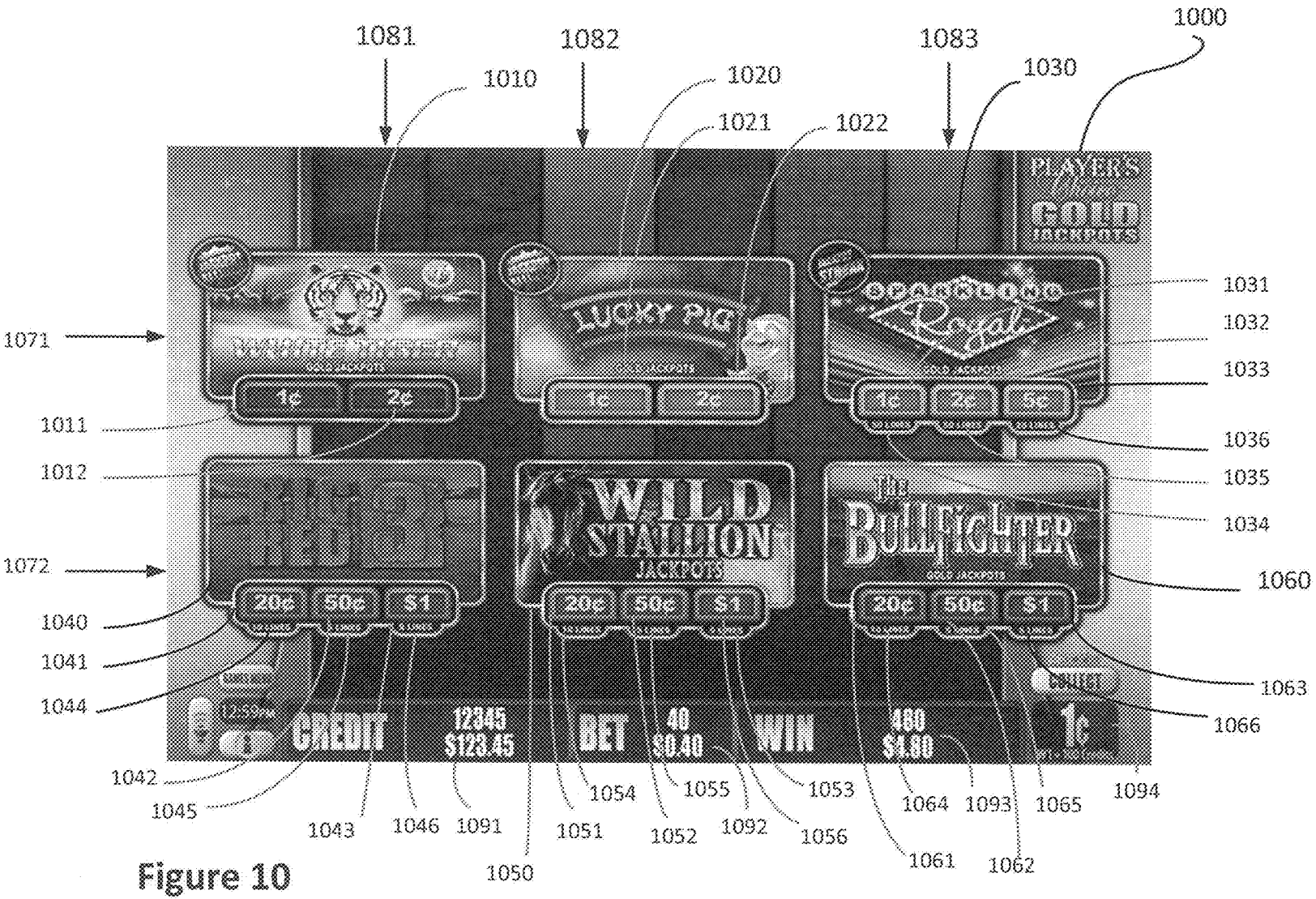
FIG. 10 is a game selection menu corresponding to the example of a selection of a game package shown in FIG. 9.

FIG. 10 shows typical game machine interface when the game machine is in a game selection mode having been configured according to the options shown selected in FIG. 9. The game selection mode will be displayed when the gaming machine is in an idle state, no game has been selected and the user has exited the configuration mode.

The user interface controller 625 causes display controller 626 to control the display 54 to display a game selection interface 1000 as shown in FIG. 10. Referring to FIG. 5 a plurality of game images 1010, 1020, 1030, 1040, 1050 and 1060 are displayed in two rows 1071 and 1072, and three columns 1081, 1082 and 1083.

Game image 1010 corresponds to the game White Tiger enables the player to select the game either by pressing on the White Tiger image in which case denominations will be presented to the player for a denomination selection by directly pressing on one of the game image sub-components 1011, 1012 which correspond to the 1 cent denomination 1011 and 2 cent denomination 102 variants of the White Tiger game.

Similarly, game image 1020 corresponds to the Lucky Pig game includes sub-components 1021, 1022 corresponding to the 1 cent and 2 cent variants. Game image 1030 corresponds to the Sparking Royals game and includes three sub-components 1031, 1032, 1033 corresponding to the 1 cent, 2 cent and 5 cent denominations variants respectively. Additional information components 1034, 1035 and 1036 are displayed under the denomination sub-components 1031, 1032, 1033 to indicate that for the 1 cent denomination variant 1031, 50 lines 1034 are played, for the 2 cent denomination variant 1032, 50 lines 1035 are played, and for the 5 cent denomination variant 1033, 50 lines 1036 are played.

Similarly, the Big Red Three game image 1040 includes a 20 cent game image sub-component 1041, corresponding to ten lines 1044, a 50 cent sub-component 1042 corresponding to five lines 1045, and one dollar sub-component 1043 corresponding to five lines 1046.

The Wild Stallion jackpots game image 1050 comprises a 20 cent denomination sub-component 1051 corresponding to ten lines 1054, a 50 cent denomination sub-component 1052 corresponding to five lines 1055, and a one dollar denomination sub-component 1053 corresponding to five lines to 1056.

The Bull Fighter game image 1060 comprises a 20 cent denomination sub-component 1061 corresponding to 10 lines 1064, a 50 cent denomination sub-component 1062 corresponding to five lines 1065, and a one dollar image sub-component 1063 corresponding to five lines 1066.

It will also be apparent that the game selection interface also displays the current values of the credit meter 1091, the bet meter 1092 and the win meter 1093 together with the most recent denomination (one cent) 1094 played on the gaming machine. The values of the meters shown in FIG. 10 are stored as meter data 644 in memory 64.

During the game selection interface mode, the controller 60 is responsive to a touch input in respect of a respective game image to touch to change the touch screen play to reflect selection of a game associated with the respective game image. In an embodiment, the player may be required to confirm their denomination selection before the game image changes to reflect the game selection, for example if the denomination selection corresponds to a change of denomination.

Figure 11:
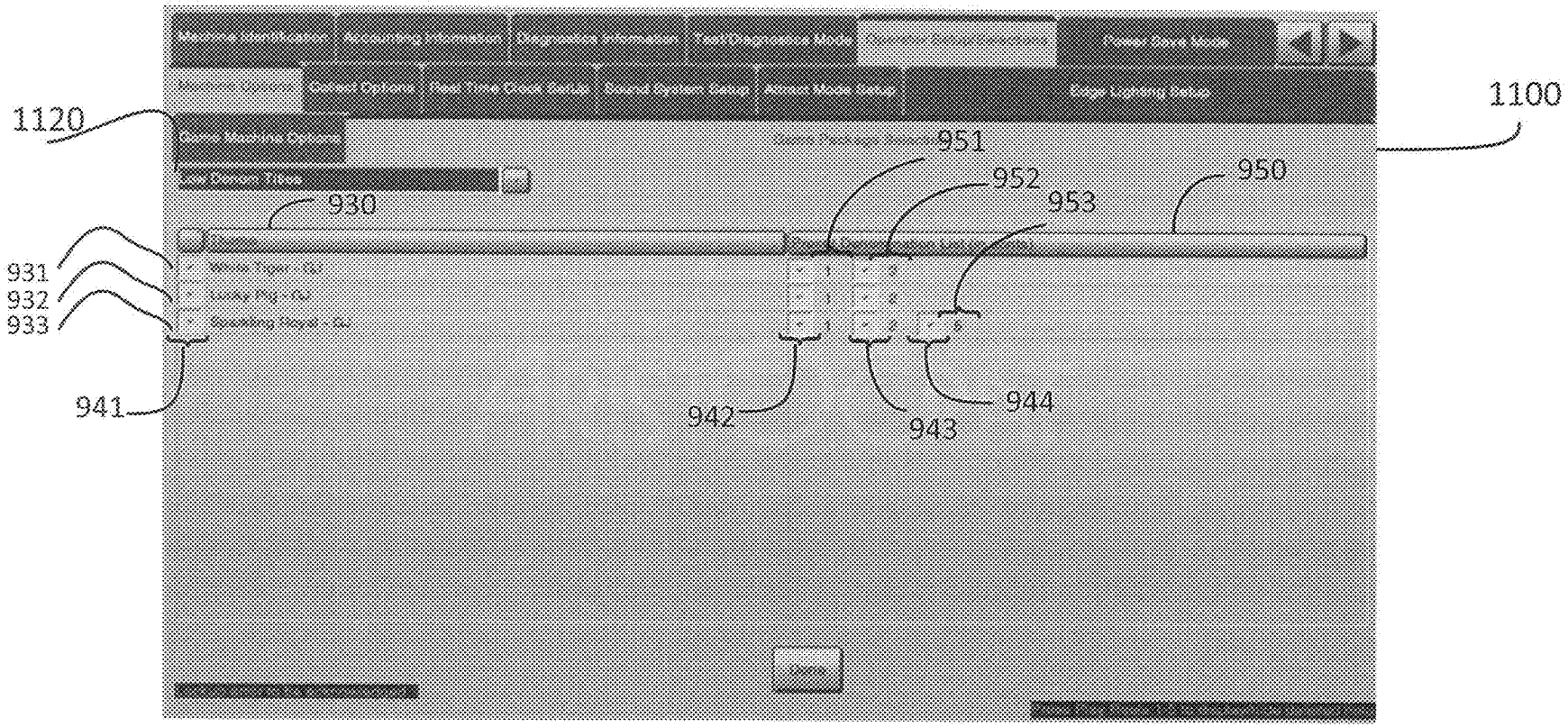
FIG. 11 shows a configuration menu of an embodiment with another example of a selection of a game package.

Referring to FIG. 11, there is shown an alternate view of the configuration menu 1100 wherein the user has selected low denomination titles package 1120. The list of available games corresponding to the selection of low denomination titles 1120 is displayed under the heading 930. That is, the games White Tiger 931, Lucky Pig 932 and Sparkling Royal 933 are the low denomination games of the low denominations package. The game denomination list 950 displays the available denominations in denomination columns 951, 952 and 953.

Again, checkboxes are provided 941, 942, 943, 944 which are subject to the same considerations in relation to checkboxes above.

Figure 12:
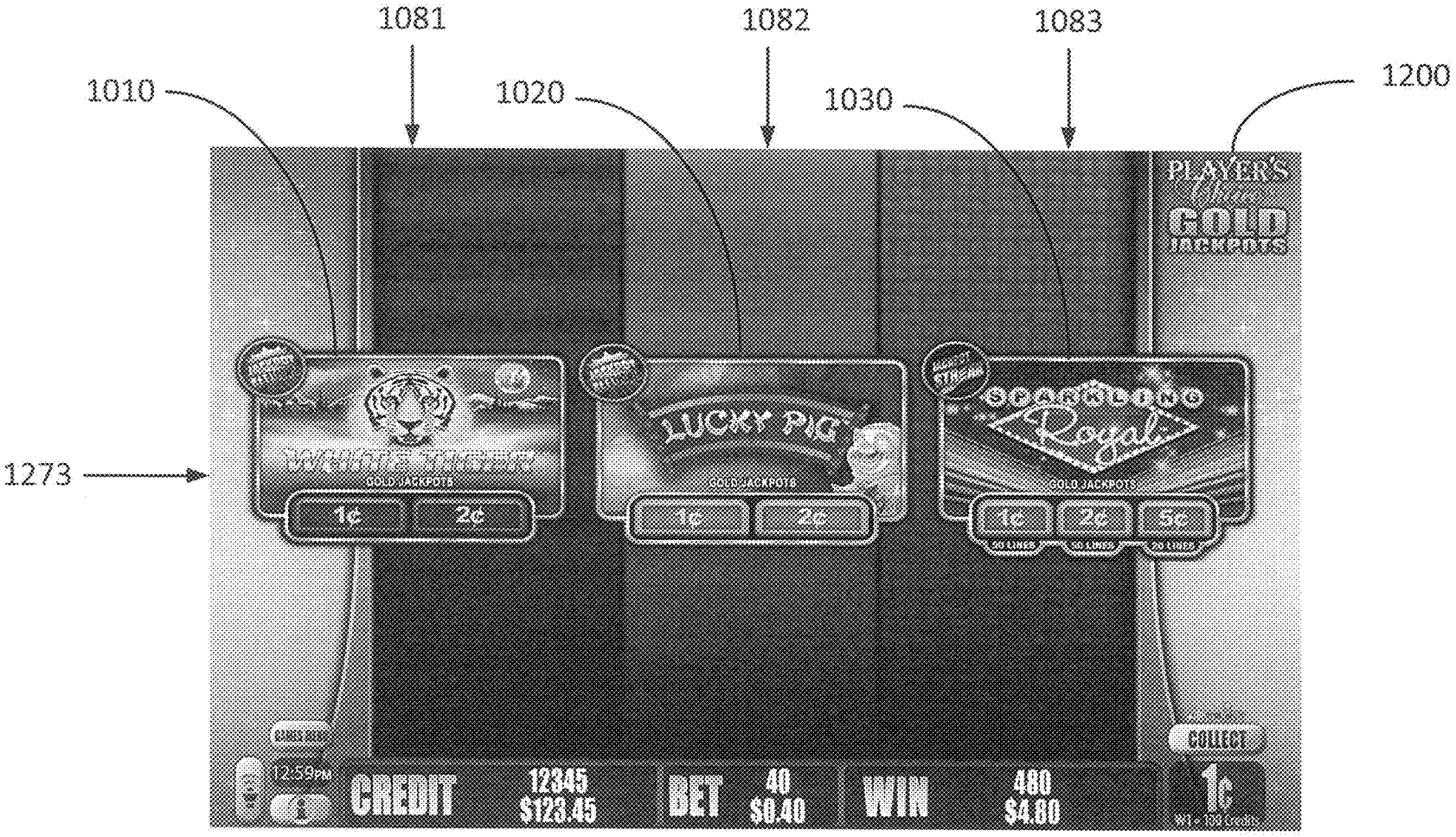
FIG. 12 is a game selection menu corresponding to the example of a selection of a game package shown in FIG. 11.

FIG. 12 is a game selection interface 1200 corresponding to the selections shown in FIG. 11. It will be apparent that the games are still displayed in three columns 1081, 1082, and 1083 but a single row of games is displayed 1273. It will also be apparent that row 1273 is positioned in the middle of the screen such that the game selection images 1010, 1020, and 1030 are evenly spaced in the middle of the screen whereas the rows 1071 and 1072 in FIG. 10 have been spaced in a different layout in order to reflect the fact that more games are available for selection.

Figure 13:
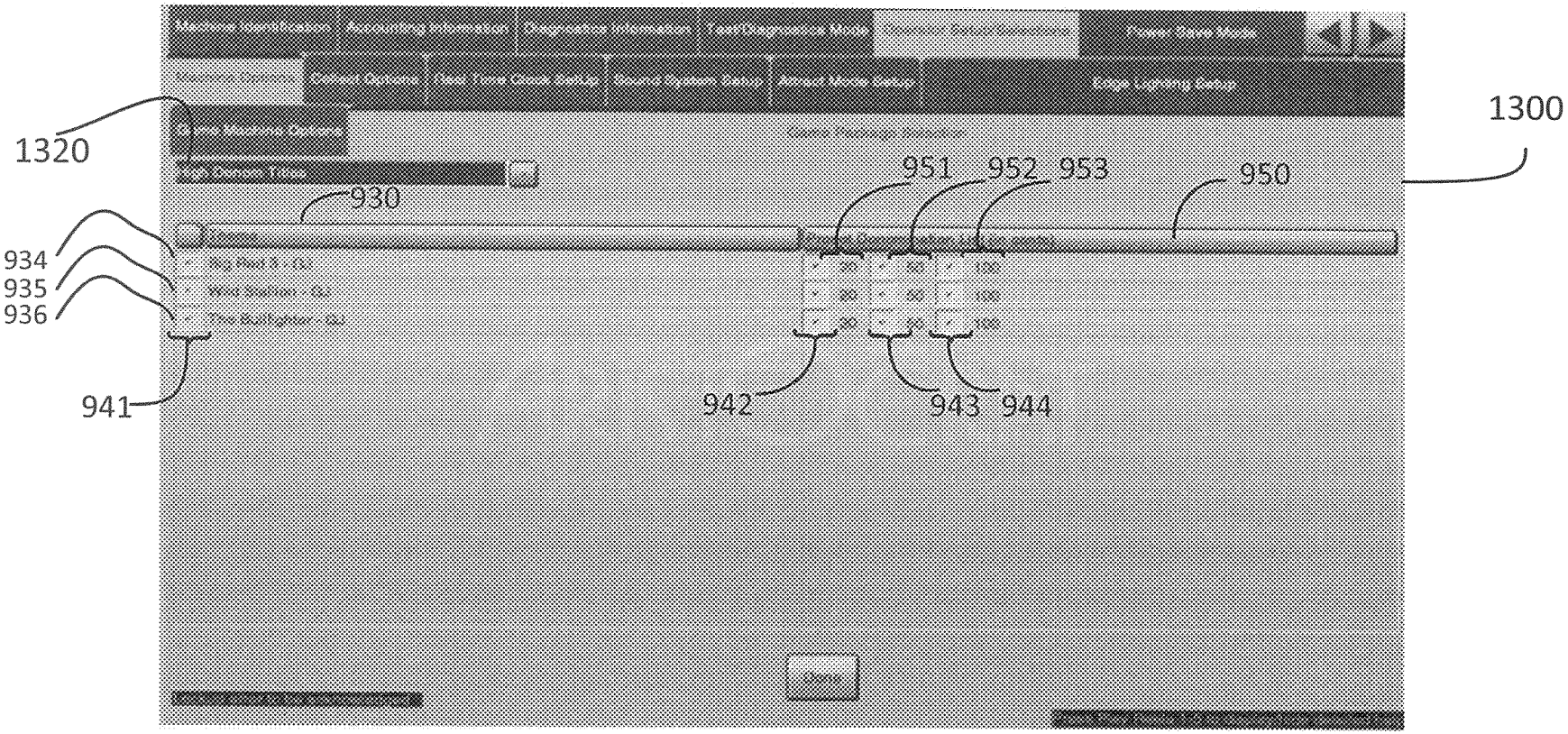
FIG. 13 shows a configuration menu of an embodiment with another example of a selection of a game package.
Figure 14:
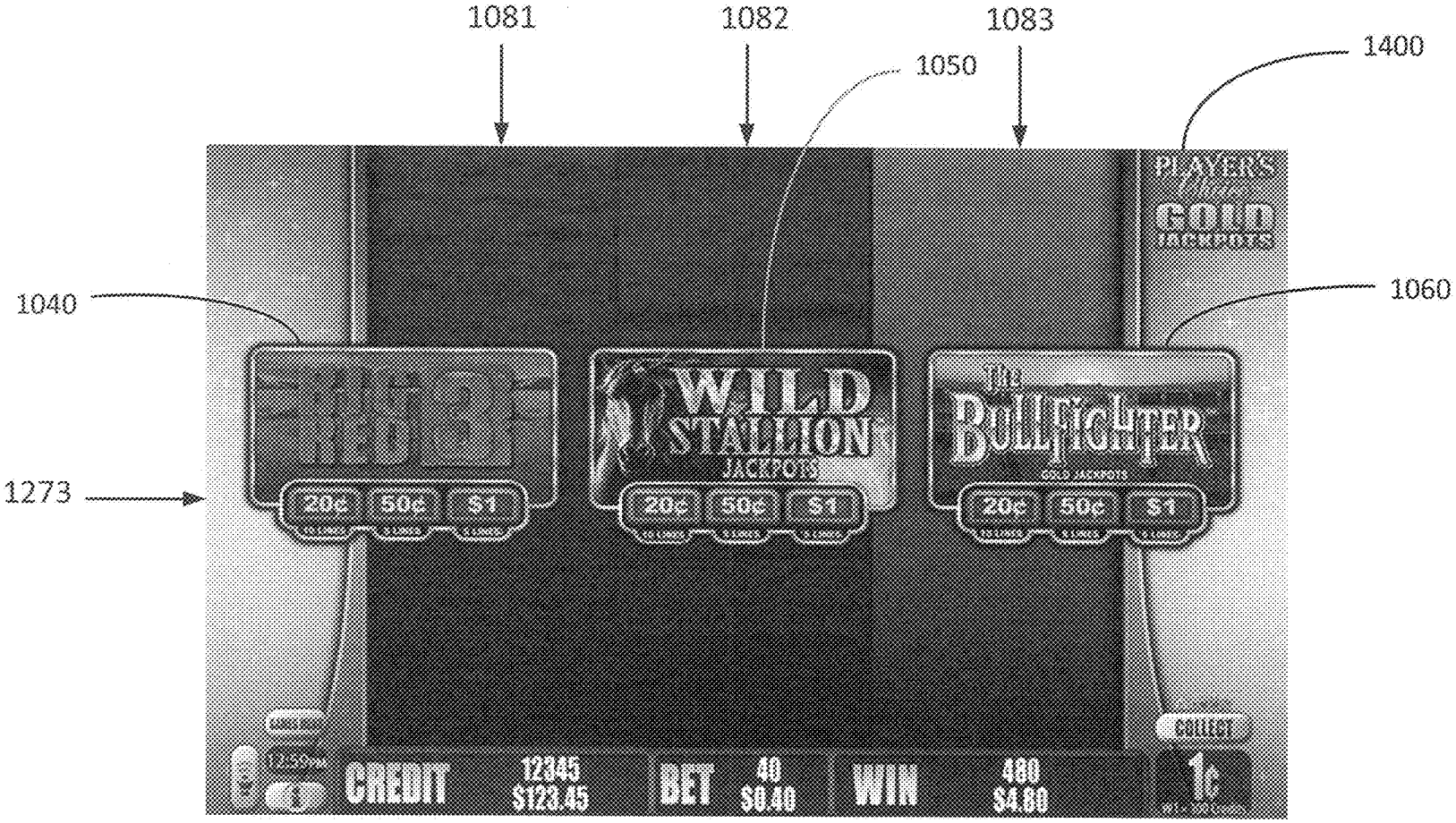
FIG. 14 is a game selection menu corresponding to the example of a selection of a game package shown in FIG. 13.

FIG. 13 corresponds to further game configuration menu 1300 in the configuration menu, this time reflecting the selection of the high denom titles 1320 which correspond to the games Big Red Three 934, Wild Stallion 935 and The Bull Fighter 936. Again, checkboxes 941 to 944 and denomination columns 951 952 and 953 indicate which denominations are available. FIG. 14 shows a game selection interface 1400 corresponding to the selection shown in FIG. 13. The game selection images 1040, 1050 and 1060 are displayed in one row 1273 with three columns 1081, 1082 and 1083.

Accordingly, it will be apparent that according to the present embodiment, the game selection interface is dynamic dependent on the game selections made in the configuration menu. It will also be apparent that the controller is configured to control the layout of the game images in the game selection interface based on the number of games. In one example, the controller is configured to select the layout of the game images from among a plurality of different layouts based on the number of games.

In an embodiment, the configuration menu also allows the user to select a return to player (RTP) variation. In an embodiment, a maximum of 8 different RTP variations are available, each comprising a full set of sub-game RTPs that are associated with a game package selection. For example, there may be 4 RTP options associated with an 'All games' game package, 2 RTP options associated with a 'Low denom' game package e and 2 RTP options associated with a "Mid/high denom" game package totaling 8 variations. In one embodiment, the RTPs may differ across different sub-games within the pack (in one example, the spread may be up to 4% overall), but remain fixed for the variation.

In an embodiment, the interface accessible is a different interface and may not be a touch screen (e.g., some buttons accessible only when the cage of the gaming machine is open)

In an embodiment, the game instructions for individual games are configured so that once a game has been selected at least one common jackpot prize maintained by the gaming machine can be won by play of any of the games playable on the gaming machine. The gaming machine 1 configured so that the chances of winning the common jackpot prize is fair irrespective of the game and denomination selected.

The controller 60 has a jackpot updater 627 which is configured to maintain at least one progressive jackpot pool for a common jackpot on a common jackpot meter 643. That is, jackpot updater 627 contributes a portion of each credit input in relation to instruction to play a game to the jackpot meter. In one embodiment, there are three different jackpots corresponding to a grand jackpot, a major jackpot and a minor jackpot and portions of each wager are attributed to each of the jackpots.

The gaming instructions 641 of each game are configured so that each game will contribute to the three shared jackpots. The progressive pools maintained on the common jackpot meter are shared by all of the games regardless of the denomination with the chance of triggering a jackpot prize being proportional. For example, so a game with a two cent denomination has twice the chance of triggering a jackpot at the same bet multiplier in a one cent denomination. In an embodiment, each jackpot prize is common across both the games in the game package and across game packages.

In the embodiments, this is achieved by each game in having its own specific method to trigger the jackpot which is specific to game play of that gaming machine as well as a random jackpot trigger. In one embodiment, different games will have different odds of a random jackpot trigger being triggered in order to compensate for any variance in odds of the game specific jackpot triggering method. As in most games, the controller has an outcome generator to generate game outcomes, for example, a selection of symbols in a spinning reel game, and an outcome evaluator 623 which evaluates game outcomes, for example, the combination of symbols displayed on the display of the gaming machine after symbols are selected as, against a pay table 644 stored in the memory 64 to determine any awards that are to be made.

In an embodiment, progressive level start up values, increment rates and ceilings are configured by the user via the configuration menu once only after a RAM clear, and are associated with the selection of the pack RTP Variation. That is, in an embodiment the progressive levels cannot be configured separately from the RTP variation. Rather, selection of the variation will force the setting of the progressive parameters in accordance with the requirements of that variation. For example, for Low Denom Pack, only the RTP variations 'Var 04' and 'Var 05' will be available to select from. If Var 04 is selected then the GRAND jackpot has start up $4000, whereas if Var 05 is selected then the GRAND jackpot has start up $5000. However, as described above, the progressive trigger method(s) may be different for each sub-game.

Figure 7A:
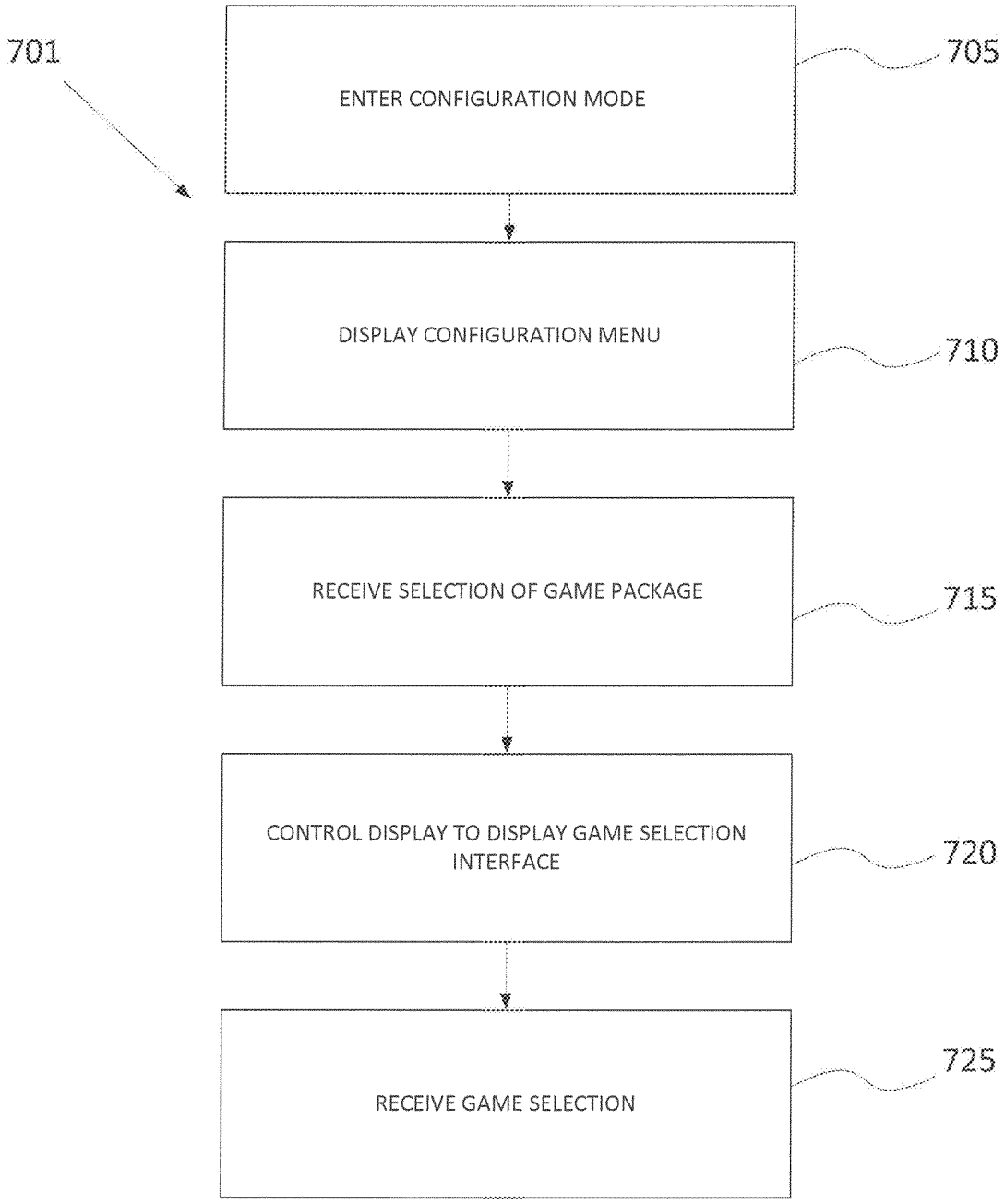
FIG. 7A is a flow chart of an embodiment.

Referring to FIG. 7A there is shown a method of operating a multi-game gaming machine 1 comprising a touch screen and a controller. The method 701 involves entering a configuration mode 705, displaying the configuration menu 710, receiving 715 a selection of a game package, controlling 720 the display of the multi-game gaming machine to display a game selection interface and receiving 725 a game selection.

Figure 7B:
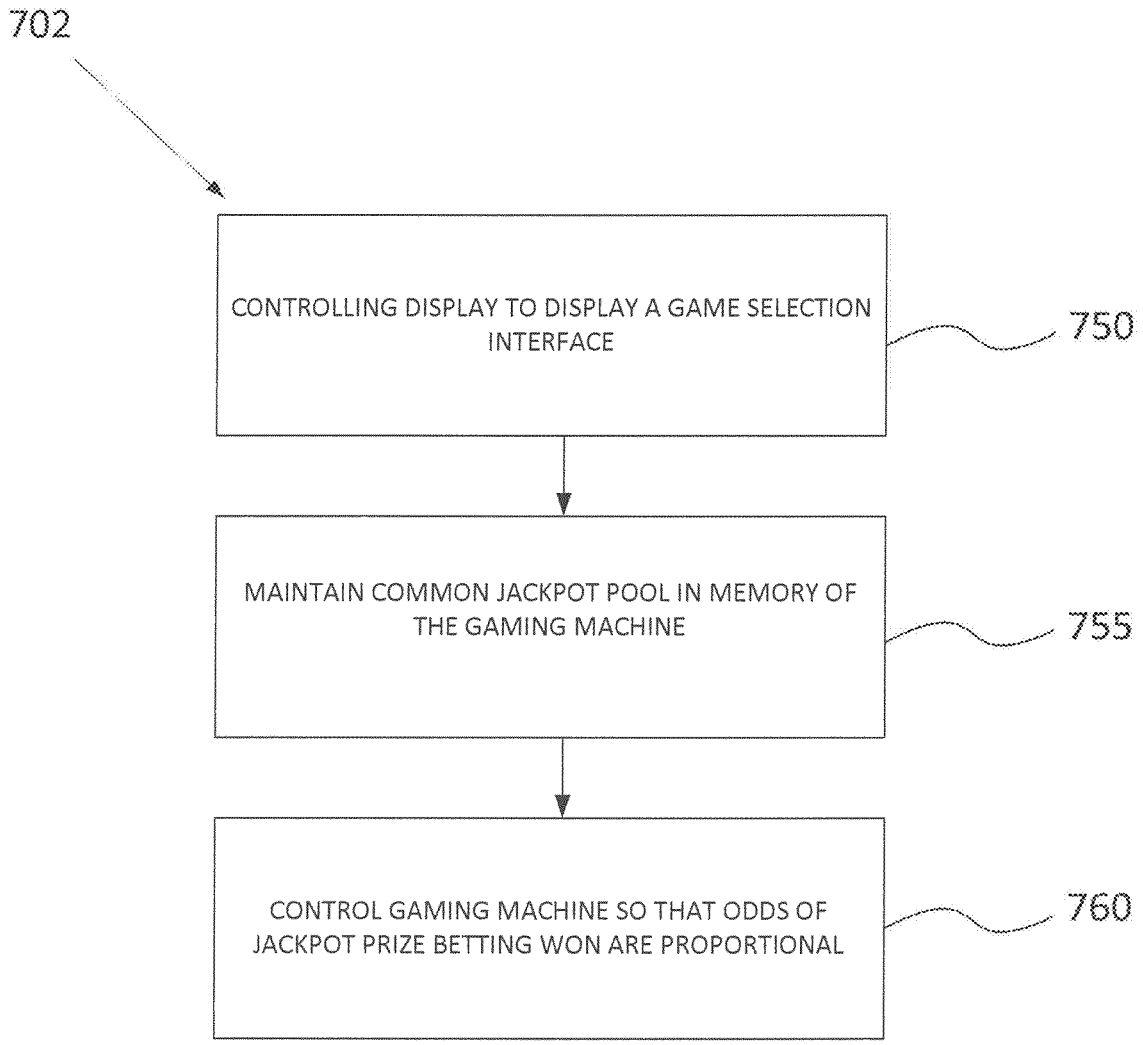
FIG. 7B is a flow chart of another embodiment.

Referring to FIG. 7B there is shown a further method of operating a multi-game gaming machine, the further method 702 comprising controlling a display to display a game selection interface 750, maintaining a common jackpot pool in memory of the gaming machine 755 and controlling 760 the gaming machine so that the odds of a jackpot prize being one are proportional irrespective of the denomination selected by the player for play.

Further aspects of the method will be apparent from the above description of the gaming machine. It will be appreciated that at least part of the method will be implemented electronically, for example, digitally by a processor executing program code such as in the above description of a game controller. In this respect, in the above description certain steps are described as being carried out by a processor of a gaming machine, it will be appreciated that such steps will often require a number of sub-steps to be carried out for the steps to be implemented electronically, for example due to hardware or programming limitations. For example, to carry out a step such as evaluating, determining or selecting, a processor may need to compute several values and compare those values.

As indicated above, the method may be embodied in program code. The program code could be supplied in a number of ways, for example on a tangible computer readable storage medium, such as a disc or a memory device, e.g. an EEPROM, (for example, that could replace part of memory 103) or as a data signal (for example, by transmitting it from a server). Further different parts of the program code can be executed by different devices, for example in a client server relationship. Persons skilled in the art, will appreciate that program code provides a series of instructions executable by the processor.

It will be understood to persons skilled in the art of the invention that many modifications may be made without departing from the spirit and scope of the invention, in particular it will be apparent that certain features of embodiments of the invention can be employed to form further embodiments.

It is to be understood that, if any prior art is referred to herein, such reference does not constitute an admission that the prior art forms a part of the common general knowledge in the art in any country.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

The invention claimed is:

1. A gaming machine, comprising:

a credit input mechanism configured to receive a physical item representing a monetary value to establish a credit balance, the credit balance being increasable and decreasable based at least on wagering activity of a player of the gaming machine;

a payout mechanism;

a credit meter configured to monitor the credit balance;

a display device;

a memory storing a first game package, a second game package, and a plurality of programs for a plurality of games that are playable on the gaming machine, wherein the first game package lists, from the plurality of games, a first selection of games that are playable at a first denomination range, and wherein the second game package lists, from the plurality of games, a second selection of games that are playable at a second denomination range; and a controller configured to execute instructions stored in the memory, which when executed, cause the controller to at least enter a configuration mode after complying with security requirements associated with the configuration mode, and enter a game selection mode after exiting the configuration mode;

wherein, when in the configuration mode, execution of the instructions further causes the controller to:

control the display device to display a configuration menu;

receive, via the configuration menu, a game package selection that selects one of the first game package and the second game package as a selected game package; and exit the configuration mode after receiving the game package selection; and wherein, when in the game selection mode, execution of the instructions further causes the controller to:

control the display device to display a game selection interface including a plurality of game images corresponding to games of the selected game package;

receive, via the game selection interface, a game selection that selects a game from the selected game package via a game image of the plurality of game images;

maintain at least one jackpot pool corresponding to a jackpot prize winnable irrespective of the game selected from the plurality of games;

maintain a chance of the jackpot prize being won proportional to a total amount wagered irrespective of the game selected from the plurality of games; and control the display device to display the selected game.

2. The gaming machine as claimed in claim 1, wherein execution of the instructions further causes the controller to control the display device to display the plurality of game images in one or more rows of multiple images and adjust a number of rows based on a number of games in the selected game package.

3. The gaming machine as claimed in claim 2, wherein execution of the instructions further causes the controller to control the display device to space the one or more rows of multiple images based on the number of games in the selected game package.

4. A method of operating a gaming machine, the method comprising:

establishing a credit balance in response to a credit input mechanism of the gaming machine receiving a physical item representing a monetary value, the credit balance being increasable and decreasable based at least on wagering activity;

monitoring the credit balance with a credit meter of the gaming machine;

displaying, via a display device of the gaming machine, a configuration menu in response to complying with security requirements associated with the configuration menu;

receiving, via the configuration menu, a game package selection that selects one of a first game package and a second game package, wherein the first game package lists a first selection of games that are playable at a first denomination range, and wherein the second game package lists a second selection of games that are playable at a second denomination range;

exiting the configuration menu after receiving the game package selection;

displaying, via the display device, a game selection interface including a plurality of game images corresponding to the games of the selected game package;

receiving, via the game selection interface, a game selection that selects a game from the selected game package via a game image of the plurality of game images;

maintaining, by a controller of the gaming machine, at least one jackpot pool corresponding to a jackpot prize winnable irrespective of the game selected from the plurality of games;

maintaining, by the controller, a chance of the jackpot prize being won proportional to a total amount wagered irrespective of the game selected from the plurality of games; and displaying, via the display device, the selected game.

5. The method as claimed in claim 4, further comprising adjusting a layout of the plurality of game images included in the game selection interface based on a number of games in the selected game package.

6. The method as claimed in claim 5, further comprising selecting the layout of the plurality of game images from among a plurality of different layouts based on the number of games in the selected game package.

7. The method as claimed in claim 4, wherein the receiving the game selection comprises receiving the game selection via a touch screen display device of the gaming machine.

8. A gaming machine, comprising:

a credit input mechanism configured to receive a physical item representing a monetary value to establish a credit balance, the credit balance being increasable and decreasable based at least on wagering activity;

a credit meter configured to monitor the credit balance;

a display device;

a memory storing a plurality of game packages and a plurality of programs for a plurality of games that are each playable on the gaming machine at a plurality of denominations, wherein each game package lists a respective selection of games from the plurality of games; and a controller configured to execute instructions stored in the memory, which when executed, cause the controller to at least:

control the display device to display a configuration menu in response to complying with security requirements associated with the configuration menu;

receive, via the configuration menu, a game package selection that selects a game package from the plurality of game packages;

exit the configuration menu after receiving the game package selection;

control the display device to display a game selection interface including a plurality of game images corresponding to games of the selected game package and a plurality of denomination images associated with each game image of the plurality of game images;

receive, via the game selection interface, a game selection that selects a game from the selected game package via a game image of the plurality of game images;

receive, via the game selection interface, a denomination selection that selects a playable denomination for the selected game via a denomination image associated with the game image that corresponds to the selected game;

maintain at least one jackpot pool corresponding to a jackpot prize winnable irrespective of the game selected from the plurality of games;

maintain a chance of the jackpot prize being won proportional to a total amount wagered irrespective of the game selected from the plurality of games; and control play of selected game per the selected playable denomination.

9. The gaming machine as claimed in claim 8, wherein:

each game has a first jackpot triggering mechanism specific to the game and a second jackpot triggering mechanism; and odds of the second jackpot triggering mechanism occurring within a specific game are such that the chance of the jackpot prize being won is proportional to the total amount wagered.

10. The gaming machine as claimed in claim 8, wherein the jackpot prize is a progressive prize, and the instructions, when executed, further cause the controller to update the jackpot prize based on jackpot contributions derived from play of the plurality of games on the gaming machine.

11. A method of operating a gaming machine, the method comprising:

establishing a credit balance in response to a credit input mechanism of the gaming machine receiving a physical item representing a monetary value, the credit balance being increasable and decreasable based at least on wagering activity;

monitoring the credit balance with a credit meter of the gaming machine;

controlling, by a controller of the gaming machine, a display device of the gaming machine to display a configuration menu in response to complying with security requirements associated with the configuration menu;

receiving, via the configuration menu, a game package selection that selects a game package from a plurality of game packages, wherein each game package lists a respective selection of games from a plurality of games playable on the gaming machine;

exiting the configuration menu after receiving the game package selection;

controlling, by the controller, the display device of the gaming machine to display a game selection interface including a plurality of game images and a plurality of denomination images associated with each game image of the plurality bf game images;

receiving, via the game selection interface, a game selection that selects a game from the selected game package via a game image of the plurality of game images;

receiving, via the game selection interface, a denomination selection that selects a playable denomination for the selected game via a denomination image of the plurality of denominations images associated with the game image corresponding to the selected game;

maintaining, by the controller, at least one jackpot pool corresponding to a jackpot prize winnable irrespective of the game selected from the plurality of games;

maintaining, by the controller, a chance of the jackpot prize being won proportional to a total amount wagered irrespective of the game selected from the plurality of games; and controlling play of selected game per the selected playable denomination.

12. The method as claimed in claim 11, further comprising:

triggering, for each game of the plurality of games, an award of the jackpot prize per a first jackpot triggering mechanism specific to the each game of the plurality of games; and triggering, for each game of the plurality of games, the award of the jackpot prize per a second jackpot triggering mechanism such that the chance of the jackpot prize being won is proportional to the total amount wagered.

13. The method as claimed in claim 11, further comprising funding the jackpot prize as a progressive prize based on jackpot contributions derived from play of the plurality of games on the gaming machine.

14. The gaming machine as claimed in claim 1, wherein:

the display device comprises a touch screen display device; and the instructions, when executed, further cause the controller to receive the game selection via a touch input of the touch screen display device.

15. The gaming machine as claimed in claim 1, wherein:

each game of the first game package is playable at a plurality of playable denominations within the first denomination range;

the game selection interface further presents the plurality of playable denominations for each game of the first game package in response to the first game package being the selected game package; and the instructions, when executed, further cause the controller to at least:

receive, via the game selection interface, a denomination selection that selects one of the plurality of playable denominations for the selected game; and control play of the selected game per the selected playable denomination.

16. The method as claimed in claim 4, further comprising:

receiving, via the configuration menu, at least one selection that selects playable denominations for each game of the selected game package;

presenting, via the game selection interface, the playable denominations for each game of the selected game package;

receiving, via the game selection interface, a denomination selection that selects a playable denomination for the selected game; and controlling play of the selected game per the selected playable denomination.

* * * * *